United States Patent [19]

Utsumi

[11] 4,362,075

[45] Dec. 7, 1982

[54] METHOD AND APPARATUS FOR SEPARATING AND FEEDING WRAPPED ARTICLES FROM A CONTINUOUS DISPENSER SHEET

[75] Inventor: Yoshikazu Utsumi, Kyoto, Japan

[73] Assignee: Tetra Pak International Aktiebolag, Lund, Sweden

[21] Appl. No.: 235,088

[22] Filed: Feb. 17, 1981

[30] Foreign Application Priority Data

Feb. 22, 1980 [JP] Japan ..... 55/21995

[51] Int. Cl.[3] ..... B26D 5/22

[52] U.S. Cl. ..... 83/42; 83/112; 83/151; 83/267; 83/276; 83/925 R

[58] Field of Search ..... 83/110, 112, 152, 151, 83/276, 277, 267, 411 R, 925 R, 42; 221/30, 71

[56] References Cited

U.S. PATENT DOCUMENTS

| | | | |
|---|---|---|---|
| 3,057,528 | 10/1962 | Cole et al. | 221/30 X |
| 3,586,586 | 6/1971 | Berg | 83/152 X |
| 3,903,768 | 9/1975 | Amberg et al. | 83/152 X |

*Primary Examiner*—James M. Meister

*Attorney, Agent, or Firm*—Amster, Rothstein & Engelberg

[57] ABSTRACT

A common intermittent drive mechanism intermittently rotates a feed roller and a cutter rotor. An intervening gear and the radii of the feed roller and the cutter rotor differentiate the circumferential speed of the roller and the rotor to provide a slip between a continuous strip-like dispenser sheet fed by the feed roller and the cutter rotor surface. A suction means in the cutter rotor surface holds the dispenser sheet while allowing the slip thereof. When the movement of the cutter rotor is interrupted, a cutter is actuated and separates the individual articles from the remaining dispenser sheet. While the separated article is carried by the moving surface of the cutter rotor for a distance greater than the pitch of the article wrapped in the dispenser sheet, another single article is moved into the position for separation, and this procedure is repeated. The apparatus may comprise chain driven grippers which, in cooperation with a cam arrangement and a spring, grips the separated article and removes it from the cutter rotor surface to carry to the next process station.

8 Claims, 9 Drawing Figures

METHOD AND APPARATUS FOR SEPARATING AND FEEDING WRAPPED ARTICLES FROM A CONTINUOUS DISPENSER SHEET

BACKGROUND OF THE INVENTION

This invention relates to methods and apparatuses for separating wrapped articles from a continuous strip-like dispenser sheet in which articles are separately wrapped at substantially equal relatively short intervals and for feeding the separated articles at desired intervals larger than the intervals between the articles wrapped in the continuous dispenser sheet.

It is often desirable to separate wrapped articles from a continuous strip-like dispenser sheet and feed them at desired intervals convenient for the subsequent process. One example is a wrapped drinking straw to be attached to a carton containing milk or the like.

Wrapping of straws for the above purpose is efficiently and conveniently effected by placing straws at equal intervals between two continuous elongated strips of plastic film along the length of the strip with the longitudinal axis of the straw substantially perpendicular to the length of the strip and welding the films together between the straws. The straws can then be provided as individual straws in the wrapped state by simply transversely separating the welded plastic film between the straws.

It is desirable to provide an efficient method and apparatus for separating wrapped straws from a continuous strip-like dispenser sheet as above described and feeding the separated straws at a desired longer spacing to a subsequent step such as the step of attaching the separated straws to milk cartons.

SUMMARY OF THE INVENTION

Accordingly, an object of the present invention is to provide an apparatus for separating and feeding film-wrapped articles capable of efficiently and reliably separating the articles from a continuous strip-like dispenser sheet.

Another object of the present invention is to provide an apparatus for separating and feeding film-wrapped articles capable of efficiently and reliably feeding the separated articles at a spacing longer than the spacing between the articles wrapped in the strip-like dispenser sheet.

Still another object of the present invention is to provide a method for separating and feeding film-wrapped articles, which is capable of separating the wrapped articles from a continuous strip-like dispenser sheet and feeding the separated articles at a desired longer spacing for the convenience of the subsequent steps.

The present invention accordingly resides in an apparatus for separating a wrapped article from a continuous strip-like dispenser sheet within which the articles are independently wrapped with a substantially equal relatively short pitch between adjacent wrapped articles, the pitch being defined as the distance between a line at right angles to the longitudinal direction of the strip-like dispenser sheet which traverses the centre of the area containing the wrapped article and a similar line traversing an adjacent wrapped article, and for feeding the separated wrapped articles with a greater spacing for the convenience of the subsequent steps. The apparatus comprises means for defining a movable surface on which the strip-like dispenser sheet containing the articles therein can be placed thereon, means for intermittently moving the movable surface along its surface direction, each movement covering a desired distance which is equal to the pitch between the articles within the strip-like wrapper multiplied by an integer, and means for applying a suction in the movable surface to hold the strip-like wrapper placed on the movable surface. The movable surface may be defined by a cylindrical surface of a rotatable cylinder. The intermittently moving means may be a link-gear arrangement connected to the rotatable cylinder so that the movable surface is moved by a distance of for example four times the pitch between the articles within the wrapper. The suction means may include conduits connected to a vacuum pump at one end and open on the movable surface at the other end so that the wrapper film placed on the movable surface is held in place by the atmospheric pressure while allowing the slippage of the wrapper with respect to the movable surface when the wrapper feeding speed is different from the moving speed of the movable surface. The apparatus also comprises means for intermittently feeding the strip-like dispenser sheet onto the movable surface. The feeding means feeds the wrapper by an amount corresponding to the pitch of the articles within the strip-like dispenser sheet at each feeding operation, and each feeding operation is effected during the each intermittent movement of the movable surface so that the feeding operation terminates at the same point in time as the termination of the intermittent moving operation. The apparatus also comprises means for separating the wrapped article from the following portion of the strip-like dispenser sheet. The separating means may be a cutter intermittently engageable with the dispenser sheet to separate the wrapped articles from the continuous strip-like dispenser sheet only when the movable surface is substantially stopped.

DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENT

Figure 1:
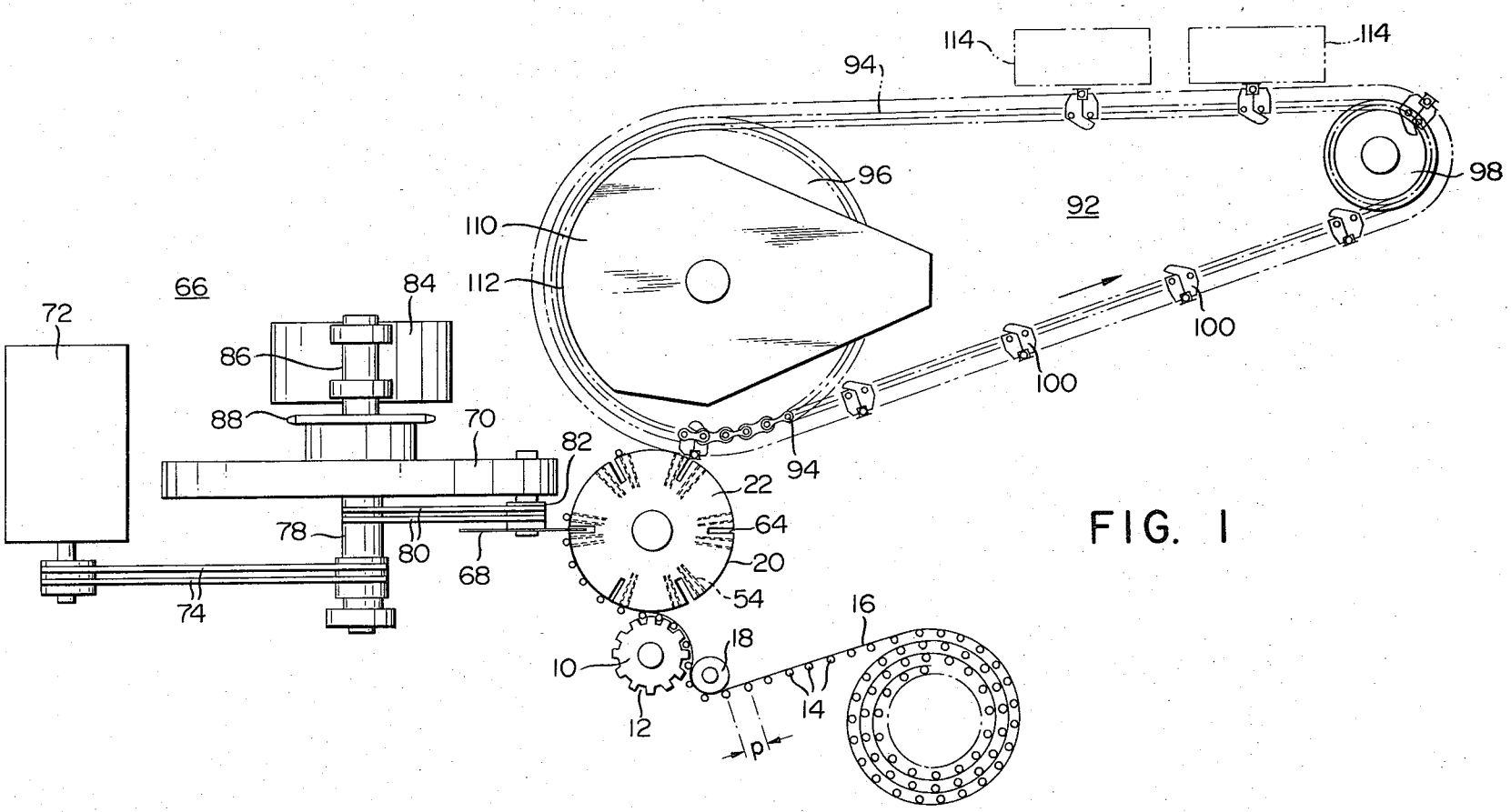
FIG. 1 is plan view schematically illustrating the outline of the separating and feeding apparatus of the present invention.

Referring now to the drawings and in particular to FIGS. 1 to 5, the feeding and separating apparatus of the present invention comprises a feed roller 10 which is a generally cylindrical rotatable member having on its circumferential surface a plurality of axial grooves 12. The pitch of the axial grooves 12 is equal to the pitch p at which articles 14 wrapped in a continuous strip-like dispenser sheet 16 are positioned and wrapped. The dispenser sheet 16 contains a plurality of articles 14 between two plastic film strips welded to each other between the articles to individually wrap the articles 14. The articles are disposed in the dispenser sheet 16 in the transverse direction with respect to the length direction of the sheet 16. The dispenser sheet 16 is supplied on the feed roller 10 with the wrapped articles 14 thereon received in the axial grooves 12 of the feed roller 10.

Figure 2:
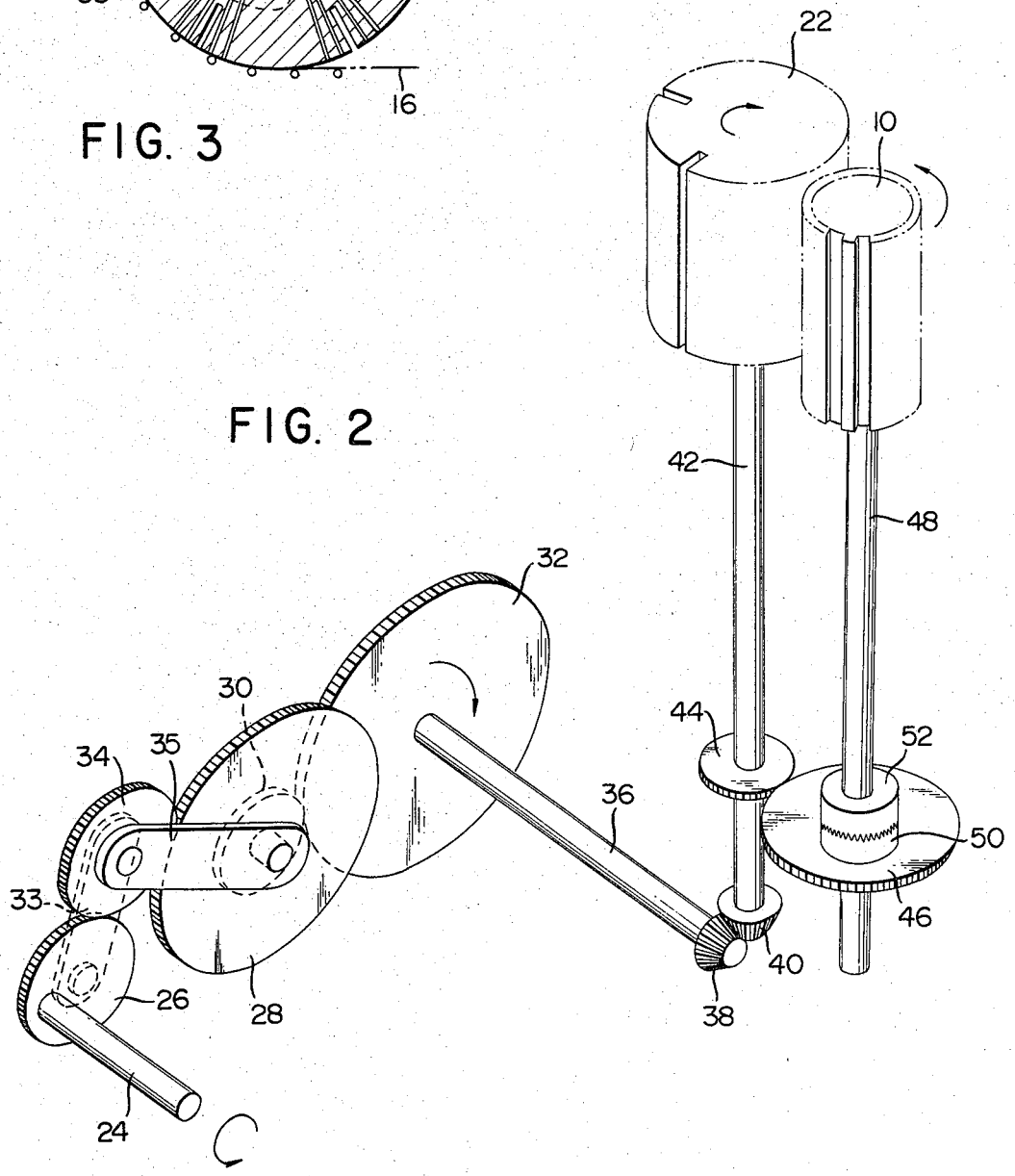
FIG. 2 is a perspective view showing the intermittent drive mechanism for driving the feed roller and the cutter rotor.

The feed roller 10 is intermittently driven by a mechanism illustrated in FIG. 2 so that each intermittent rotation of the feed roller 10 feeds the continuous strip-like dispenser sheet 16 by an amount corresponding to one pitch P of the articles 14. In the illustrated embodiment, the number of the grooves 12 of the feed roller 10 is twelve and the grooves 12 are provided at equal intervals corresponding to the pitch P. Therefore each intermittent rotation of the feed roller 10 through 30° feeds one wrapped article. A roller 18 serves to guide the wrapper 16 into engagement with the feed roller 10.

The wrapped articles 14 intermittently fed from the feed roller 10 are supplied on a cylindrical surface 20 of the cutting rotor 22 which is intermittently rotatable about an axis parallel to the rotational axis of the feed roller 10. A mechanism for intermittently driving the cutting rotor 22 is illustrated in FIG. 2.

The intermittent drive mechanism comprises an input shaft 24 connected to and driven at a constant speed by an unillustrated electric motor. The input shaft 24 is rotatably supported by a frame structure (not shown) and has fixedly mounted thereon an eccentric gear 26. Also rotatably supported on the frame structure (not shown) are a spur gear 28, a pinion 30 fixed on the spur gear 28, and a spur gear 32. The intermittent drive mechanism also comprises a floating gear 34 which is rotatably supported on one end of a first link 36 pivotally supported at the other end at the center of the eccentric gear 26 and which is rotatably supported on one end of a second link 38 which is pivotally supported at the other end on the center of the spur gear 28. Thus, the gear 34 is always in meshing engagement with both the eccentric gear 26 and the spur gear 28 because of the links 36 and 38 movably supporting the floating gear 34. It is to be understood that, with the rotation of the eccentric gear 26 about its eccentric axis of rotation, the effective gear ratio between the eccentric gear 26 and the floating gear 34 periodically varies between of the eccentricity of the gear 26, so that the output shaft of the intermittent driving mechanism which is connected to the spur gear 32 is driven at a periodically varying speed, and that the minimum speed of the output shaft can be selected to be zero by properly selecting the eccentricity of the eccentric gear 26. In the intermittent drive mechanism utilized in the present invention, the eccentricity of the eccentric gear 26 or the dimensional relationship of the link-gear mechanism is determined so that the output shaft 36 of the mechanism is intermittently rotated, i.e., the speed of the output shaft 36 gradually increases after a short stop and gradually decreases to a stop after it has one reached maximum speed. Subsequently the same operation will again be repeated. The overall gear ratio of the intermittent drive mechanism is selected to be 1:6. The output shaft 36 has mounted thereon a bevel gear 38 which is in meshing engagement with another bevel gear 40 mounted on a rotatable shaft 42 surmounting the cutter rotor 22. The gear ratio of the gears 38 and 40 is 1:1. Therefore, when the input shaft 24 makes a complete turn, the cutting rotor 22 rotates by one-sixth of a complete rotation or 60° during which the rotation speed of the cutting rotor 22 varies between zero and the maximum value.

FIG. 2 also illustrates a mechanism for intermittently driving the feed roller 10. This mechanism includes the intermittent drive mechanism that is a part of the mechanism for intermittently driving the cutter rotor 22. Thus, the intermittent drive mechanism composed of the link-gear arrangement is utilized in common in both driving mechanisms for the feed roller 10 and the cutter rotor 22. The intermittent drive mechanism for the feed roller 10 includes a gear 44 secured on the shaft 42 coupled to the output shaft 36 by means of bevel gears 38 and 40. The gear 44 is in engagement with a gear 46 rotatably mounted on a rotatable shaft 48 which at one end supports the feed roller 10. The second gear 46 is freely rotatable on the shaft 48 but not movable in the axial direction. The second gear 48 has secured thereon a clutch disc 50. Engaging with the first clutch disc 50 is a second clutch disc 52 which is mounted on the shaft 48 to be movable in the axial direction but not in the circumferential direction by means of splines formed between the shaft and the second clutch disc 48. The second clutch disc 52 is actuable by a conventional operating mechanism (not illustrated) such as an electromagnetic solenoid and a linkage. The second clutch disc 52 is usually biased toward the first clutch disc 50 by means of a spring (not illustrated), so that unless an electrical signal for disengaging the clutch is supplied to the operating mechanism, the clutch is maintained engaged to transmit intermittent rotating force provided by the gear 44 to the feed roller 10.

It is to be noted that the gear ratio between the gear 44 and the second gear 46 is 1:2, and the ratio of the radii of the cutter rotor 22 and the feed roller 10 is 2:1, and that there is a clearance between the cutter rotor 22 and the feed roller 10. Therefore, during each intermittent movement or 60° rotation of the cutter rotor 22, the feed roller 10 rotates by 15° and the outer surface of the cylindrical feed roller 10 moves a distance one-fourth of the movement of the cylindrical surface of the cutter rotor 22. Thus, there is a difference in speed between the feeding surfaces of the cutter rotor 22 and the feed roller 10.

Figure 3:
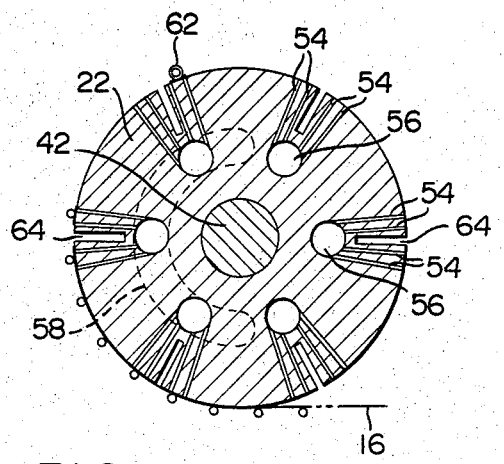
FIG. 3 is a sectional view of the cutter rotor illustrating the suction means formed therein.

In order to hold the strip-like dispenser sheet 16 supplied on the movable surface 20 on the cutter rotor 22, means for applying a suction on the movable surface 20 is provided as shown in FIG. 3. The suction means comprises a plurality of conduits 54 radially extending and opening at one end in the cylindrical surface 20 of the cutter rotor 22 and connected at the other end with axially extending bores 56 each of which has an open end in one of the side faces of the cutter rotor 22 and has a closed end. The open end of each of the axial bores 56 is disposed along a circle concentric with the axis of rotation of the cutter rotor 22 and is capable of being communicated with an arcuated opening 58 formed in a stationary disc 60 when one of the axial bores 56 is brought in registry with the arcuated opening 58. The arcuated opening 58 in the disc 60 is connected to a vacuum pump via a suitable tube in a known suitable manner, although this is not illustrated. Thus, in operation, a subatmospheric pressure generated by the vacuum pump generates a suction in the radial conduits 54 in the cutter rotor 22 when the open ends of the axial bores 56 are in registry with the arcuated opening 58 so as to hold the dispenser sheet 16 fed from the feed roller 10. It is to be noted that even when the individual wrapped article 14 is separated from the continuous dispenser sheet 16 as described in detail later, the separated wrapped article 62 can be maintained by suction on the movable surface 20 of the cutter rotor 22 owing to the distributed suction openings 54.

As the continuous dispenser sheet 16 is intermittently fed by the feed roller 10 on the movable surface of the cutter rotor 22 by a length corresponding to one pitch of the article 14 at each intermittent feed, since the moving speed of the movable surface 20 of the cutter rotor 22 is four times that of the feed roller 10, the fed dispenser sheet 16 is moved along the moving surface 20 only at a feeding rate of the feed roller 10 with a slip between the dispenser sheet 16 and the movable surface 20 which is permitted by the yieldable suction holding force provided by the suction means.

In FIG. 3 it is seen that the cutter rotor 22 has formed in its movable cylindrical surface 20 a plurality of slots 64 extending substantially in the axial direction for allowing the cutter means which will be described in detail later to pass therethrough to separate the dispenser sheet 16. In the illustrated embodiment, there are six slots 64 disposed at equal angular intervals and between the suction openings 54. The positional relationship between the individual articles 14 wrapped in the continuous dispenser sheet 16 and the axial slots 64 of the cutter rotor 22 is such that, when the continuous dispenser sheet 16 is fed and held on the movable surface 20 of the cutter rotor 22, the slots 64 of the cutter rotor 22 are positioned substantially at the midpoint between the articles 14 in the sheet 16 where the films are welded together. In the illustrated embodiment, the axial slots 64 are positioned so that they are in registry with every fourth space between the articles, i.e., when the dispenser sheet 16 is wound on the cutter rotor 22, four articles 14 are presented between neighbouring slots 64.

As previously described, the speed of movement of the movable surface 20 of the cutter rotor 22 is four times the feed speed of the feed roller 10. Therefore, each time the feed roller 10 intermittently feeds the continuous dispenser sheet 16, the movable surface 20 or the axial slots 64 for receiving the cutter of the cutter rotor 22 intermittently move a distance four times the pitch of the articles 14 in the sheet 16, so that whenever the movement of the cutter rotor 22 is interrupted, the axial slots 64 thereof always come in registry with the welded portions of the films between the articles 14 of the continuous dispenser sheet 16 which is also stopped, thereby allowing the cutter means to be passed through one of the axial slots 64.

Figure 4:
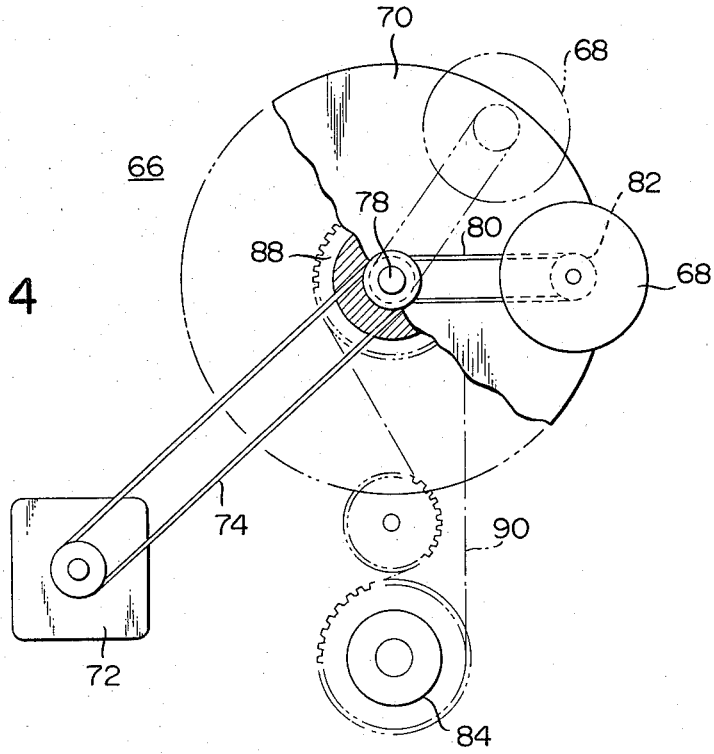
FIG. 4 is a schematic view illustrating the intermittent rotary cutter mechanism.

The cutter mechanism 66 is actuated in synchronization with the cutter rotor 22 so that it is actuated and passes through the slot 64 of the cutter rotor 22 only when the latter is stopped. As best seen in FIGS. 1 and 4, the cutter mechanism 66 comprises a disc cutter 68 rotatably and eccentrically mounted on the rotatable disc 70. The cutter 68 is driven by an electric motor 72 through a V-belt and pulley mechanism including a first V-belt 74 connecting a pulley 76 on the motor 72 to a rotatable shaft 78 rotatably and coaxially mounted on the disc 70, and a second V-belt 80 connecting the shaft 78 rotatable relative to the rotatable disc 70 to a pulley 82 secured to the cutter 68. The cutter mechanism 66 also comprises a second motor 84 which drives the rotatable disc 70 about its central shaft 86 by means of sprockets including a driven sprocket 88 secured to the disc 70 and a chain 90 connecting the sprockets. The driving mechanism for the disc 70 is related to the drive mechanism for the cutter rotor 22 so that the cutter 68 on the disc 70 passes through the axial slots 64 each time the latter is stopped. This correlation may be achieved by any suitable well known arrangement, including the use of the same electric motor used for driving the feed roller 10 and the cutter roter 22 also for driving the cutter disc 70.

When the cutter rotor 22 stops temporarily at a predetermined position such as shown in FIG. 1, the cutter 68 passes through the axial slots 64 in the cutter rotor 22 thereby to separate the continuous dispenser sheet 16. The separated wrapped article 62 is held on the cutter rotor 22 due to the suction applied thereto. After the cutter 68 passes through the slots 64 in the cutter rotor 22, due to the intermittent drive mechanism shown in FIG. 2, the cutter rotor 22 together with the feed roller 10 is again rotated with the separated article 62 held on the movable surface 20. During this rotation of the cutter rotor 22, the cutter rotor 22 is driven by 60° or a distance corresponding to four times the pitch of the articles until the rotor 22 stops again, and during this same period of time the feed roller 10 rotates 15° and feeds the continuous dispenser sheet 16 forward by a distance equivalent to one pitch of the article, so that the first article now separated is separated from the second article in the dispenser sheet by a distance equal to four times the pitch while the second article is moved into the same position as that in which the now separated first article was previously located. This step is repeated.

Figure 5:
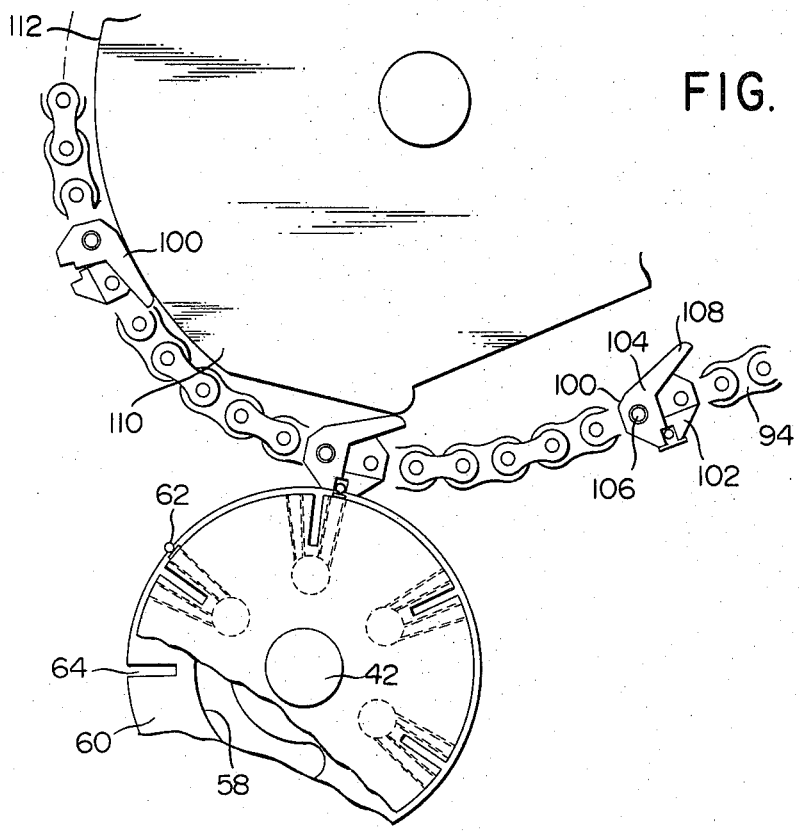
FIG. 5 is a fragmental view illustrating the removal means including the grippers.

The apparatus of the present invention also comprises means for splitting and removing the separated wrapped articles 62 from the movable surface 20 of the cutter rotor 22. This removing mechanism generally indicated by the reference numeral 92 comprises an endless chain 94 wound and driven around sprockets 96 and 98, the sprocket 96 being located at the position close to the cutter rotor 22. The endless chain 94 has attached thereon a plurality of grippers 100 mounted at predetermined equal intervals. As best seen in FIG. 5, each gripper 100 comprises a stationary member 102 which may be an element similar to the other chain links but different in having a jaw, a movable member 104 pivotable about a pin 106 of the chain 94 and in having a jaw opposing the jaw of the stationary member 102 and a lever 108, and a spring (not shown) for biasing the jaw of the movable member 104 toward the jaw of the stationary member 102 to grip and hold the wrapped article 62 between the jaws of the gripper 100. In order to open the jaws of the gripper 100 to receive the article 62 on the cutter rotor 22, a cam member 110 having a cam surface 112 is provided. The cam surface 112 engages and pushes the lever of the movable member 104 of the gripper 100 as the latter approaches the cutter rotor 22 to open the jaws of the gripper 100. When the gripper 100 receives the separated article 62 within its jaws, the cam surface 112 allows the movable member 104 to return to its initial position under the action of the biasing spring of the gripper 100 to grip and hold the separated article 62 by the spring action. As the gripper moves away from the movable surface of the cutter rotor 22, the article 62 gripper by the gripper 100 is separated and removed from the cutter rotor 22 and carried to the subsequent station such as shown in FIG. 1 wherein each of the separated wrapped articles 62 may be bonded to a milk carton 114 or the like. The drive mechanism for driving the gripper 100 along the loop is synchronized with the intermittent drive mechanism for the cutter rotor 22 and the feed roller 10 by any suitable known arrangement so that the gripper 100 receives each separated article 62 on the cutter rotor 22. The suction applied to the separated article 62 on the cutter rotor 22 is preferably removed immediately after the separated article 62 is gripped by the gripper 100. In order to achieve this, the illustrated embodiment has the arcuated opening 58 which serves as a valve for opening and closing the axial bores 56 at desired time points.

Figure 6:
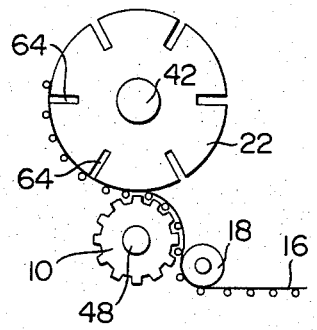
FIGS. 6 to 9 are schematic views illustrating the manner in which the articles are separated from the continuous dispenser sheet and are removed for the next step.
Figure 7:
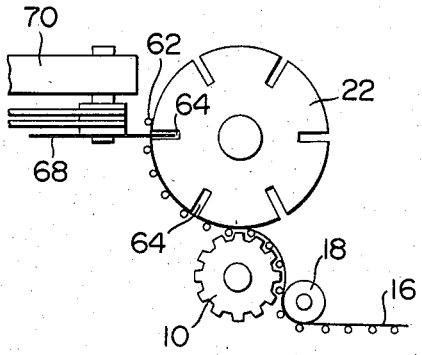
Figure 8:
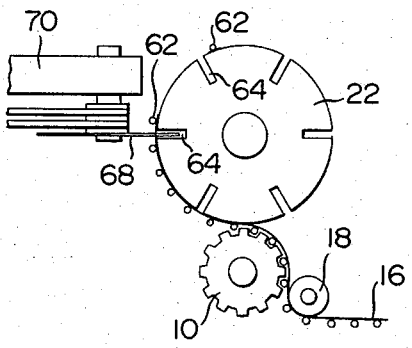
Figure 9:
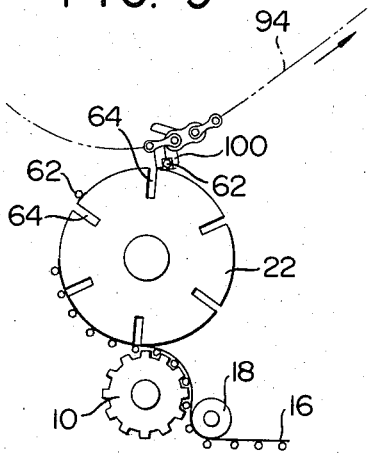

FIGS. 6 to 9 diagrammatically illustrate the manner in which the wrapped article 14 in the continuous dispenser sheet 16 is separated and fed to the next station. In FIG. 6, the continuous dispenser sheet 16 is fed on the cutter rotor 22 and moved to a position ready for cutting. In FIG. 7, the cutter 68 is actuated and the first article is separated from the dispenser sheet 16. In FIG. 8, the separated first article 62 is moved by 60° or a distance corresponding to four times the pitch and the second article 14 is moved by one times the pitch to the position ready for separation. FIG. 9 shows that the first separated article 62 is now being gripped by the gripper 100 and at the instant of being removed from the cutter rotor 22 while the cutter rotor 22 and the feed roller 10 are on the way to the stop positions.

What is claimed is:

1. An apparatus for separating a wrapped article from a continuous strip-like dispenser sheet in which the articles are separately wrapped at positions spaced by a substantially equal pitch in the longitudinal direction of the sheet and for feeding the separated wrapped articles at desired pitches larger than the positional pitch of the articles in the dispenser sheet, comprising:

means for defining a movable surface on which the dispenser sheet can be placed;

means for intermittently moving said movable surface along its surface and in the longitudinal direction of the dispenser sheet to be fed, each intermittent movement of said movable surface covering a desired distance which is equal to the pitch of the articles in the dispenser sheet multiplied by an integer;

means for applying a suction on said movable surface to yieldably hold the dispenser sheet on the movable surface;

means for intermittently feeding the dispenser sheet onto said movable surface, each intermittent feed feeding a single wrapped article by the pitch of the articles in the dispenser sheet and terminating at the same point in time as the termination of each intermittent movement of said movable surface; and means for separating the article from other wrapped articles in the dispenser sheet, said separating means being actuated only when said movable surface is substantially stopped.

2. A separating and feeding apparatus as claimed in claim 1, wherein said movable surface defining means comprises a rotatable cylinder and said movable surface is a cylindrical surface of said cylinder.

3. A separating and feeding apparatus as claimed in claim 1 or 2, further comprising means for removing separated wrapped articles from said movable surface.

4. A separating and feeding apparatus as claimed in claim 3, wherein said removing means comprises a gripper for gripping the separated article on the movable surface, an endless driving means for driving said gripper along a loop extending between a first position in the vicinity of said movable surface and a second position relatively remote from said first position, and means for actuating said gripper to open and close said gripper for gripping the article on the movable surface.

5. A separating and feeding apparatus as claimed in claims 1 or 2, wherein said suction means comprises a subatmospheric pressure source, and a conduit having one end opened in said movable surface and the other end connected to said subatmospheric pressure source.

6. A separating and feeding apparatus as claimed in claim 5, wherein said suction means further comprises a valve disposed in said conduit, said valve opening only during the time period between the feed of the dispenser sheet on the movable surface and the removal of the separated article from said movable surface in terms of each of said open one end of said conduit.

7. A separating and feeding apparatus as claimed in claims 1 or 2, wherein said separating means comprises a rotary disc cutter rotatably mounted on a rotatable member, said disc cutter being eccentric with respect to the axis of rotation of said rotatable member.

8. A method for separating a wrapped article from a continuous strip-like dispenser sheet in which the articles are separately wrapped at positions spaced by a substantially equal pitch in the longitudinal direction of the sheet and for feeding the separated articles at desired pitches larger than the pitch of the articles in the dispenser sheet, comprising the steps of:

defining a movable surface on which the dispenser sheet can be supplied, said movable surface being movable along its surface;

intermittently moving said movable surface in the longitudinal direction of the dispenser sheet to be fed thereon, each intermittent movement of said movable surface covering a desired distance which is equal to the pitch of the articles in the dispenser sheet multiplied by an integer while applying a suction in said movable surface to yieldably hold the dispenser sheet on the movable surface;

intermittently feeding the dispenser sheet onto said movable surface, each intermittent feed feeding a single wrapped article by the pitch of the articles in the dispenser sheet and terminating at the same point in time as the termination of each intermittent movement of said movable surface; and separating the article from other wrapped articles in the dispenser sheet, when said movable surface is substantially stopped between the intermittent movements.

* * * * *